US006779284B2

(12) United States Patent
Cagliari et al.

(10) Patent No.: US 6,779,284 B2
(45) Date of Patent: Aug. 24, 2004

(54) VARIABLE-RIGIDITY SPORTS BOOT

(75) Inventors: Peter Cagliari, Montebelluna (IT); Riccardo Perotto, Venegazzu (IT)

(73) Assignee: Lange International S.A., Fribourg (CH)

( * ) Notice: Subject to any disclaimer, the term of this patent is extended or adjusted under 35 U.S.C. 154(b) by 81 days.

(21) Appl. No.: 10/313,997

(22) Filed: Dec. 6, 2002

(65) Prior Publication Data

US 2003/0126763 A1 Jul. 10, 2003

(30) Foreign Application Priority Data

Dec. 11, 2001 (CH) ..... 2254/01

(51) Int. Cl.[7] ..... A43B 5/00
(52) U.S. Cl. ..... 36/117.1; 36/50.5; 36/45
(58) Field of Search ..... 36/117.1, 118.2, 36/45, 50.5

(56) References Cited

U.S. PATENT DOCUMENTS 5,189,815 A * 3/1993 Pozzobon et al. ..... 36/117.3
5,381,611 A * 1/1995 Tonel et al. ..... 36/117.1
5,499,461 A 3/1996 Danezin et al.
5,647,150 A 7/1997 Romanato et al.
5,839,735 A 11/1998 Benoit
5,875,566 A * 3/1999 Bourdeau et al. ..... 36/12
6,076,285 A * 6/2000 Caeran et al. ..... 36/115
6,371,494 B1 4/2002 Bonaventure et al.
6,444,074 B1 9/2002 Marega
6,467,195 B2 * 10/2002 Pierre et al. ..... 36/50.5

FOREIGN PATENT DOCUMENTS

| | | |
|---|---|---|
| DE | 19527320 | 1/1997 |
| EP | 1059045 A | 12/2000 |
| EP | 1066767 A | 1/2001 |
| FR | 2694167 A | 2/1994 |
| WO | WO 9603186 | 2/1996 |
| WO | WO 0053045 A | 9/2000 |

* cited by examiner

*Primary Examiner*—M. D. Patterson
(74) *Attorney, Agent, or Firm*—Bugnion S.A.; John Moetteli

(57) ABSTRACT

The boot for gliding sports, particularly for skiing, comprises a rigid shell (2) for partially surrounding a user's foot, a collar (3) articulated on the shell (2), and an inner boot, said shell (2) including an open part that makes it easier to put the boot on and to take it off. The boot also comprises at least one flexible element (6) covering said open part so as to close the boot, and a semirigid element (7, 8) superposed over said flexible element (6), and means (9) for fixing said elements on the rigid shell (2).

9 Claims, 3 Drawing Sheets

VARIABLE-RIGIDITY SPORTS BOOT

BACKGROUND OF THE INVENTION

The present invention relates to a boot for gliding sports, particularly for skiing, comprising a rigid shell, for partially surrounding a user's foot, a collar and an inner boot, said boot including an open part for making it easier to put on and take off.

PRIOR ART

Gliding sports, particularly skiing, have shown up several contradictory requirements in the area of boots. Firstly, boots must have a rigid structure so as correctly to transmit the user's movements to the ski or the board for gliding. Secondly, it is also necessary to use flexible parts in order to address the user's comfort, but also to make it possible to put boots on and to take them off under optimum conditions.

Different types of boots for gliding sports have been developed and are known in the prior art, particularly the following publications, the content of which is incorporated in the present application by reference.

By way of example, international application WO 96/03186, the content of which is incorporated by reference, shows a snowboarding boot that comprises a single-piece rigid shell surrounding the user's foot and heel, but having an opening on the top of the foot and the front of the lower leg, and a flexible part covering the open part of the rigid shell. This flexible part also includes means for fastening a lace, such as eyelets and loops, in order to close the boot. Moreover, the boot sole comprises means for directly interacting with the bindings of the board for gliding.

Another, similar sports boot is known from U.S. patent application U.S. Pat. No. 5,839,735, the content of which is incorporated by reference. This also comprises a rigid shell and a second part, forming an overlay, made from relatively flexible material that is attached and fixed on the rigid shell.

Another boot for gliding sports is known from U.S. patent application U.S. Pat. No. 5,499,461, the content of which is incorporated by reference. This boot includes a relatively rigid power circuit, that centralizes stresses, and a relatively flexible circuit capable of making the foot comfortable, the two circuits being integral with a common reference element consisting of the boot sole. The rigid circuit comprises, in particular, a shell with a rear stiffener for the heel and a collar articulated on the stiffener. The flexible circuit, in turn, consists of a flexible inner boot surrounding the user's foot and lower leg. This boot also comprises an outer protective envelope. The lower part of the inner boot and the protective envelope may be connected simultaneously to the shell by means of lateral stitching.

However, this boot has the disadvantage of being complex to manufacture because it comprises numerous devices for fastening the various elements together.

Another type of boot is described in German Patent Application DE 195 27 320, the content of which is incorporated by reference. This boot is composed of an inner boot proper, and a separate outer shell, and there is no permanent link between these two separate elements.

Finally, another variable-rigidity sports boot is known from U.S. patent application U.S. Pat. No. 6,371,494, the content of which is incorporated by reference. This boot is formed from an outer upper comprising a rigid, non-flexible first portion, a second portion that is both rigid and flexible, fixed on the first portion and/or on the sole, and a flexible third portion fixed on the second portion. The arrangement of these three portions relative to one another is such that, apart from the areas needed for fixing them together, they are not superposed.

SUMMARY OF THE INVENTION

The object of the invention is primarily to improve known boots for gliding sports.

More particularly, an object of the invention is to provide a boot for gliding sports that is both rigid and flexible in order to allow good control of the gliding device by the user and realistic sensations, and that is also agreeable to wear and easy to put on or take off. Moreover, the boot has to be simple to manufacture and include a low number of different elements.

The boot according to the invention is defined by the characteristics of claim 1.

Dependent claims 2 to 8 define particular embodiments of the boot according to the invention.

BRIEF DESCRIPTION OF THE DRAWINGS

The invention will be better understood from the description of an embodiment thereof and of the figures relating thereto.

DESCRIPTION OF THE PREFERRED EMBODIMENTS

Figure 1:
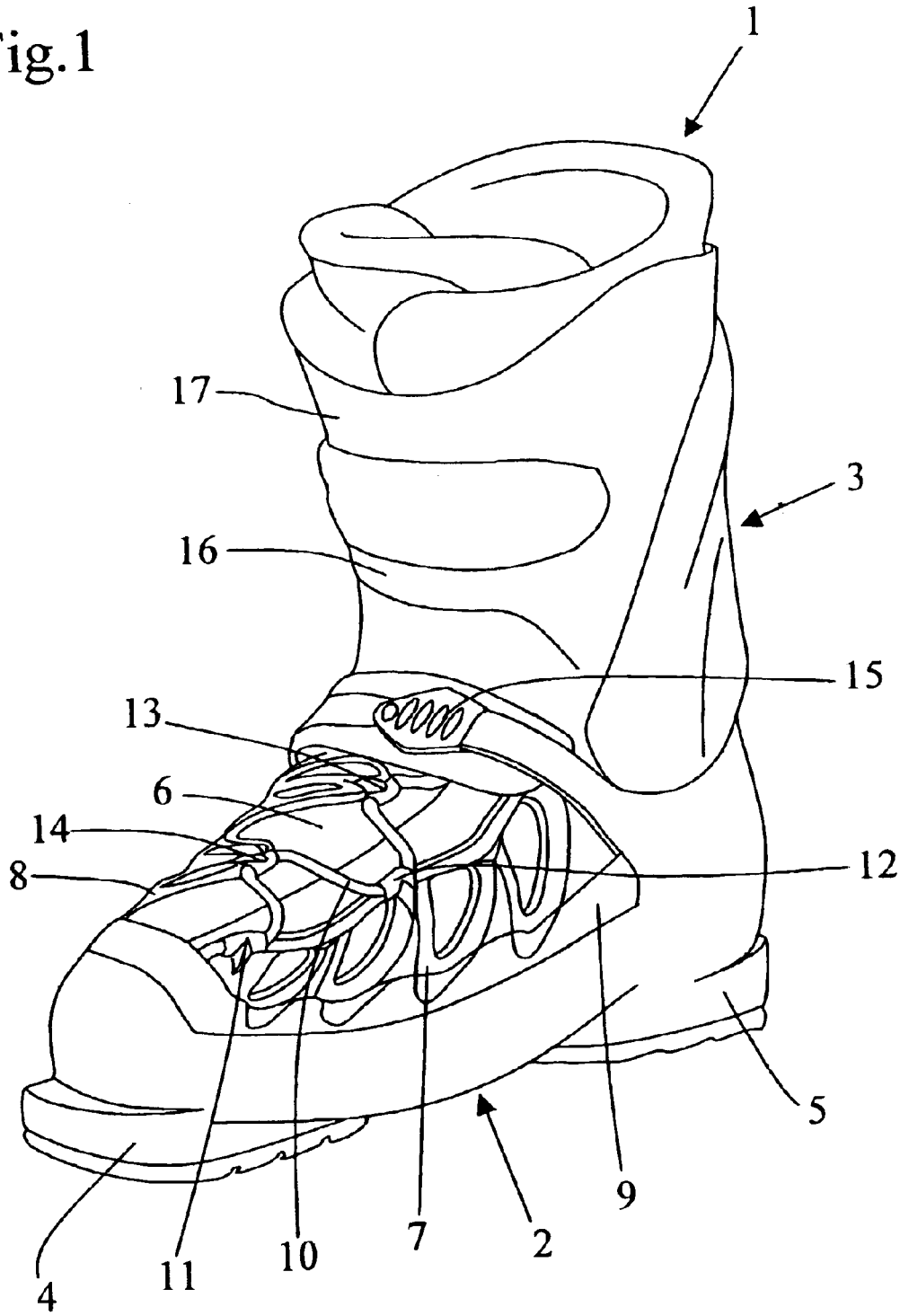
FIG. 1 shows a front three-fourths perspective view of a ski boot according to the invention.

The ski boot 1 shown in FIG. 1 comprises, in particular, a shell made from rigid material, for example from polypropylene, and a collar 3 fixed, for example in an articulated manner, to said shell 2. Conventionally, the shell 2 comprises a front curb 4 and a rear curb 5 over which the bindings of the board for gliding (not shown) clip. It may also be equipped with a rubber sole to facilitate walking. Moreover, in a known manner, it is equipped with a comfort inner boot.

The boot also comprises a flexible element 6 covering the open part of the shell 2, at least one semirigid element 7 and 8, and a linking element 9 allowing the semirigid element 7, 8 to be secured to the shell 2. The boot also includes closure means formed, in particular, by a lace 10 passing through loops 11, 12, 13, and 14 attached to the semirigid elements 7 and 8, and conventional loop-and-rack systems 15, 16, and 17 (shown diagrammatically in the figure).

The open part of the shell 2 extends at least over the top of the shell in the area corresponding to the user's instep, as far as the area corresponding to the user's ankle.

Figure 2:
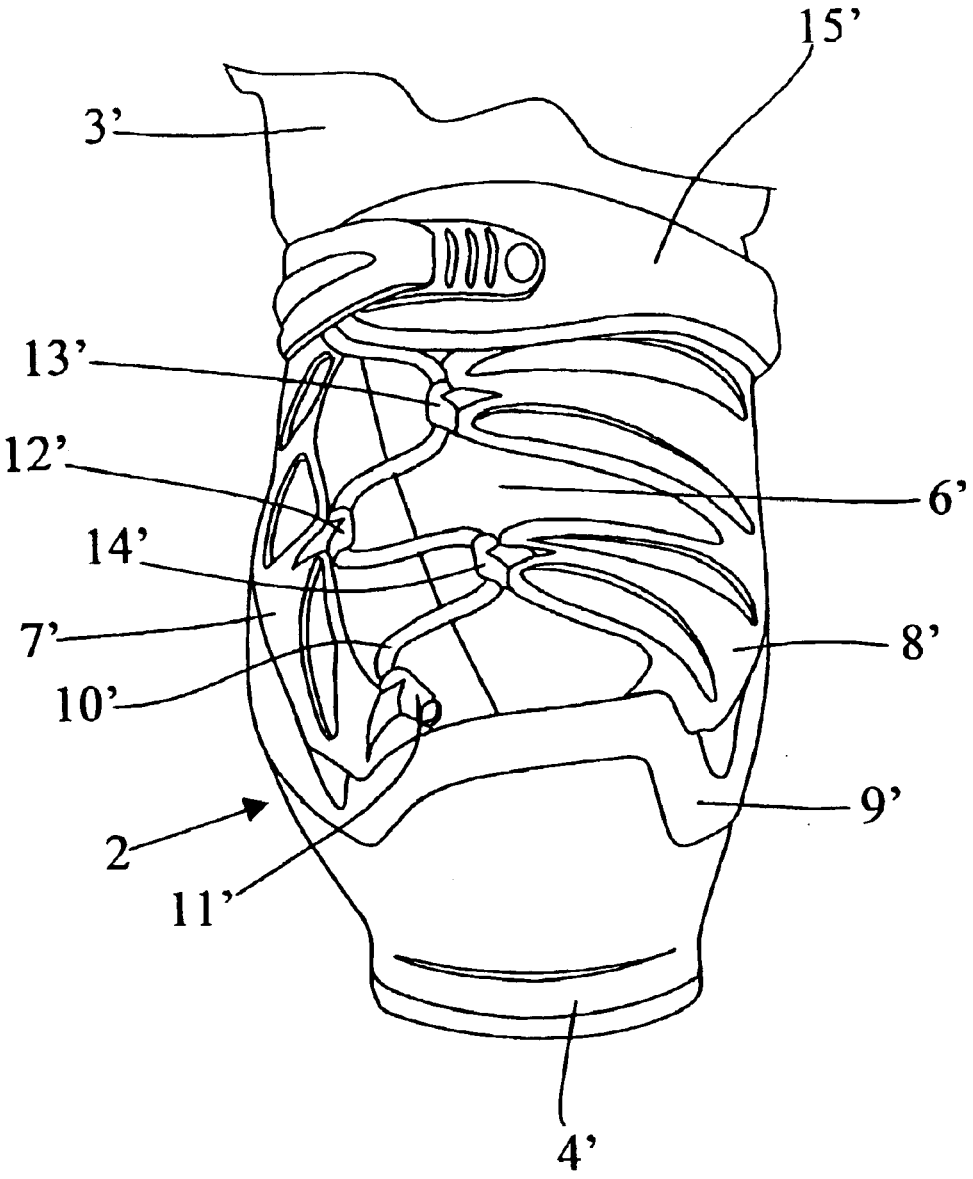
FIG. 2 shows a perspective, front partial view of a ski boot according to the invention.

FIG. 2 shows a boot for the left foot, with the same characteristics as those described in FIG. 1, so that the corresponding references are used with a' in order to differentiate them. This boot thus comprises a rigid shell 2', with an articulated collar 3', a front curb 4', a flexible element 6' closing the boot, semirigid elements 7' and 8', and a linking element 9'. Moreover, there are also fastening means represented diagramatically by a lace 10' passing through the loops 11', 12', 13', and 14', and a loop-and-rack system 15'.

Figure 3:
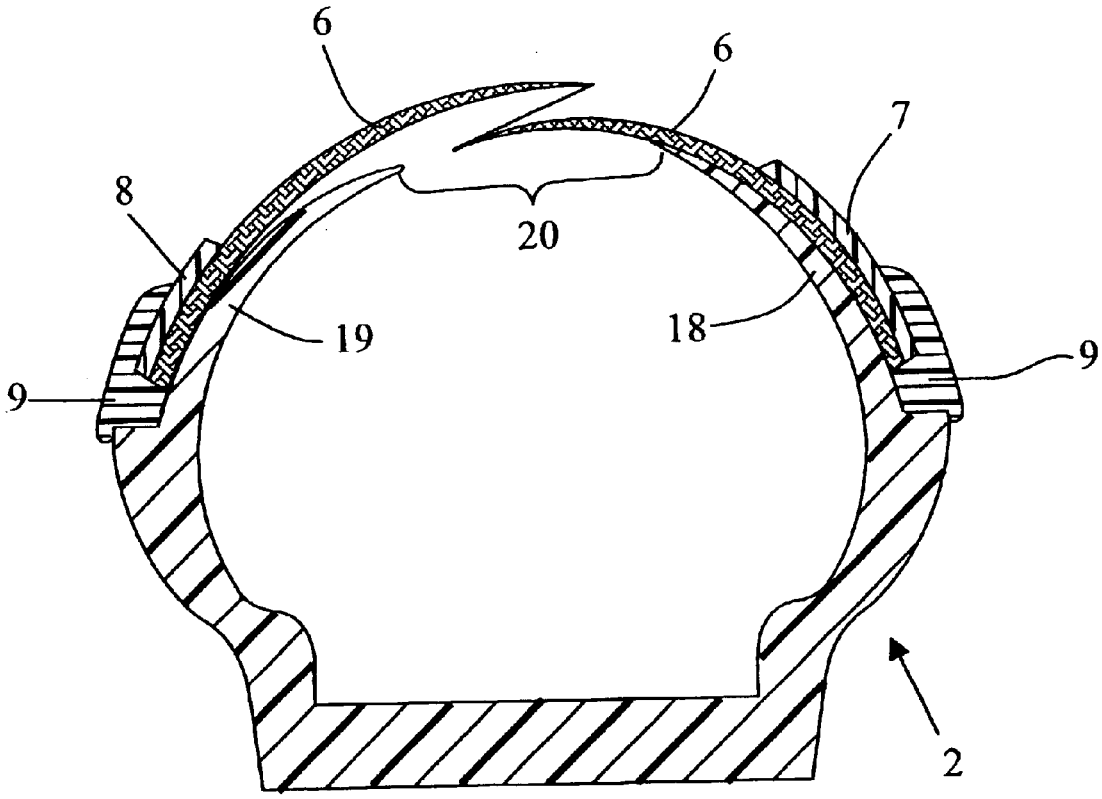
FIG. 3 shows a sectional view of the ski boot in FIG. 1.

The invention is described in greater detail with the aid of FIG. 3. This sectional figure shows the rigid shell 2 on which the flexible element 6 is placed. This flexible element 6 is composed preferably of two parts fixed, respectively, on either side of the shell 2 above the sectors 18 and 19 of the shell. Between these two sectors 18 and 19, the rigid shell 2 has an opening 20, and this opening 20 is closed by the two parts of the flexible element 6, which overlap. The two parts of the flexible element 6 are preferably linked together by a connection piece, and they are made from any material that can be sewn.

Semirigid elements 7 and 8 are located on either side of the shell 2 over the two parts of the flexible element 6. These semirigid elements 7 and 8 are attached to the flexible element 6 by stitching, and are preferably made from polypropylene.

In order to securely attach the flexible element 6 and the semirigid elements 7 and 8 to the shell 2, use is made of a linking part 9 surrounding the shell 2, as shown in FIGS. 1 and 2. This linking part 9 is made from polypropylene, and forms the link between the shell 2 and the semirigid elements 7, 8 by means of injection overmolding. The flexible part 6 and the semirigid elements 7, 8 are thus secured to the shell 2.

The various elements mentioned above may be manufactured from any material other than polypropylene, provided they are mutually compatible. The materials used may also be treated with a primer (surface treatment with a product carrying out a surface attack), or with a paint, so as to allow attachment of the materials together at the time of the injection overmolding.

Preferably, the flexible part 6 extends as far as the area corresponding to the user's ankle joint. Consequently, the semirigid elements 7, 8 and the linking part 9 are also extended so as to obtain sufficient fixing of the flexible part on the shell 2 in the manner described above.

Adjustment of the tautness of the lace 10 (or 10') may be achieved by any appropriate means, for example by means of a locking hook or an adjustable loop.

The process for manufacturing a boot according to the invention comprises, among others, the following stages:

injection-molding of the boot shell;

linking of the rigid, flexible elements and of the flexible element by means of stitching;

fastening of said semirigid elements and of the flexible element sewn on the shell by injection overmolding of a linking part.

This process is thus very simple, and makes it possible easily to produce not only the boot shells but also the flexible elements, and the rigid and flexible elements, to link the various elements together and, lastly, to assemble the shell and said elements in order to form the boot.

What is claimed:

1. A boot for gliding sports, particularly for skiing, comprising a rigid shell (2, 2') having a cutout (20) on its upper face so as not to cover over the top of a user's foot, but to partially enclose that foot, at least one flexible element (6, 6') extending in said cutout (20) so as to close the boot, a collar (3, 3') articulated on the shell (2, 2'), and an inner boot, wherein the flexible element is outside the shell, and wherein the boot comprises a semirigid element (7, 8; 7', 8') superposed on said flexible element (6, 6') and means (9, 9') of linking said elements to the rigid shell (2, 2').

2. The boot as claimed in claim 1, wherein said flexible element (6, 6') comprises two flaps that overlap so as to close the boot in a leaktight manner.

3. The boot as claimed in claim 1, wherein the two flaps (6, 6') are sewn, respectively, to a semirigid element (7, 8; 7', 8').

4. The, boot as claimed in claim 1, wherein said linking means (9, 9') comprises a material connecting the semirigid element (7, 8; 7', 8') to the shell (2, 2').

5. The boot as claimed in claim 4, wherein the shell, the semirigid element (7, 8; 7', 8'), and the linking material (9, 9') are made from polypropylene, and wherein the link between the shell (2, 2'), the semirigid element (7, 8; 7', 8'), and the linking part (9, 9') is produced by injection overmolding.

6. The boot as claimed in claim 1, wherein said linking means (9, 9') comprises an injectable material, wherein the two flaps (6, 6') are fixed to the rigid shell (2, 2'), and wherein the semirigid element (7, 8; 7', 8') is linked to the shell (2, 2') by injection overmolding of the linking material (9, 9').

7. The boot as claimed in claim 2, wherein said linking means (9, 9') comprises an injectable material, wherein the two flaps (6, 6') are fixed to the rigid shell (2, 2'), and wherein the semirigid element (7, 8; 7', 8') is linked to the shell (2, 2') by injection overmolding of the linking material (9, 9').

8. The boot as claimed in claim 1, wherein the semirigid element (7, 8; 7', 8') comprises means for tightening the boot.

9. The boot as claimed in claim 8, wherein the means for tightening the boot comprise at least loops (11, 12, 13, 14; 11', 12', 13', 14') attached to the rigid and flexible element (7, 8; 7', 8') and associated with a lace (10, 10').

* * * * *